United States Patent [19]

Hammons et al.

[11] Patent Number: 5,062,327

[45] Date of Patent: Nov. 5, 1991

[54] YOKE NUT TIGHTENING WRENCH

[76] Inventors: Alva C. Hammons, 760 Yell Rd.; James R. Sanders, 949 Midway St.; Franklin J. Ulrich, 1199 Nashville Highway, Apt. 14, all of Lewisburg, Tenn. 37091

[21] Appl. No.: 635,740

[22] Filed: Dec. 28, 1990

[51] Int. Cl.[5] ..... B25B 13/06

[52] U.S. Cl. ..... 81/124.3; 81/119

[58] Field of Search ..... 81/121.1, 124.3, 124.7, 81/119, 176.2

[56] References Cited

U.S. PATENT DOCUMENTS

| | | | |
|---|---|---|---|
| D. 103,579 | 3/1937 | McNaught | 81/124.3 |
| 2,864,273 | 12/1958 | Hentosh | 81/124.7 |
| 3,083,598 | 4/1963 | Kinnison | 81/124.3 |

FOREIGN PATENT DOCUMENTS

| | | | |
|---|---|---|---|
| 746310 | 3/1933 | France | 81/119 |

*Primary Examiner*—D. S. Meislin

*Attorney, Agent, or Firm*—Phillips & Beumer

[57] ABSTRACT

A wrench having a specific configuration which permits it to be used in tightening a nut which secures a yoke of a yoke/universal joint assembly with the end of a shaft of a drive shaft assembly of a vehicle. The nut is generally seated in a recessed opening in the body of the yoke between a pair of extending trunnions and is secured to a threaded shaft on a stub shaft which extends into an opening in the recess of the yoke. The wrench includes an elongated handle, neck, and a nut engaging head. The neck is provided with specific curvatures which permit the wrench to be inserted into the yoke and a handle having cutout side surfaces which permit the handle to be rotated in a wider arc than could be achieved with a handle having straight sides. The head is provided with an extending portion having an internal nut engaging portion for engaging the nut. The extending portion is provided with an external diameter which is smaller than the inner annular surface of the recess to permit the extending portion to "reach" into the recess so that the internal nut engaging surfaces may encompass the nut. The wrench permits the nut to be rotated without disassembling the yoke/U-joint assembly, as is usually required.

7 Claims, 1 Drawing Sheet

YOKE NUT TIGHTENING WRENCH

FIELD OF THE INVENTION

This invention is directed generally to wrenches and more particularly to a wrench specifically used to reach into confined spaces such as the yoke of universal joints in vehicles.

BACKGROUND OF THE INVENTION

The majority of vehicles such as automobiles, trucks, and construction and farm equipment employ the use of a drive shaft between the rear end (differential) and the transmission of these vehicles. Typically, the drive shaft is connected at one end to the transmission by a yoke and universal joint assembly and at its second end to the differential by a second yoke and universal joint assembly. One of the yokes of each assembly is secured to the end of a stub shaft which respectivelly extends from the transmission housing and differential housing. These yokes are secured to the stub shafts by nuts.

A problem encountered in such construction is that after a period of use (particularly in the heavier vehicles), the nuts tend to become loosened and must be tightened.

In order to tighten these nuts, the yoke and universal joint generally must be disassembles so that an impact wrench or the like can be placed on the nut to provide the necessary tightening force. No tool is currently available to enable one to merely reach inside the yoke with the tool to tighten the nut.

In order to disassemble the yoke and universal joint assemblies, it is sometimes necessary to use a wrench, and any number of tools which may include a hammer, chisel, air compressor, air hose, air wrench, an elongated steel bar, wooden block, hydraulic jack, etc. Of course, after each of the yoke and universal joint assemblies have been disassembled and the nuts have been tightened, it is necessary to reassemble the yoke and U-joint assemblies.

Such procedure is time-consuming and sometimes very frustrating. Applicants propose to minimize the down time of the vehicle and to simplify the nut tightening procedure by providing a wrench which is designed to reach inside the yoke and universal joint assembly and engage the nut without the need to disassemble the yoke and U-joint assembly. In such procedure, down time is kept to a minimum, and the number of tools required is kept to a minimum. Also, by providing a proper tool and simplified procedure for the nut tightening process, the tendency by the mechanic to bypass the nut tightening operation (during periodic maintenance procedures) because of the complexity and time involved is eliminated.

It is an object of the present invention to provide a procedure for tightening the nut of the yoke in a yoke universal joint assembly of a vehicle.

It is another object of the present invention to provide such a procedure which eliminates the need for disassemblying the yoke and universal joint assembly of the vehicle.

BRIEF DESCRIPTION THE DRAWINGS

DESCRIPTION OF THE PREFERRED EMBODIMENT

Figures 1, 2, 3:
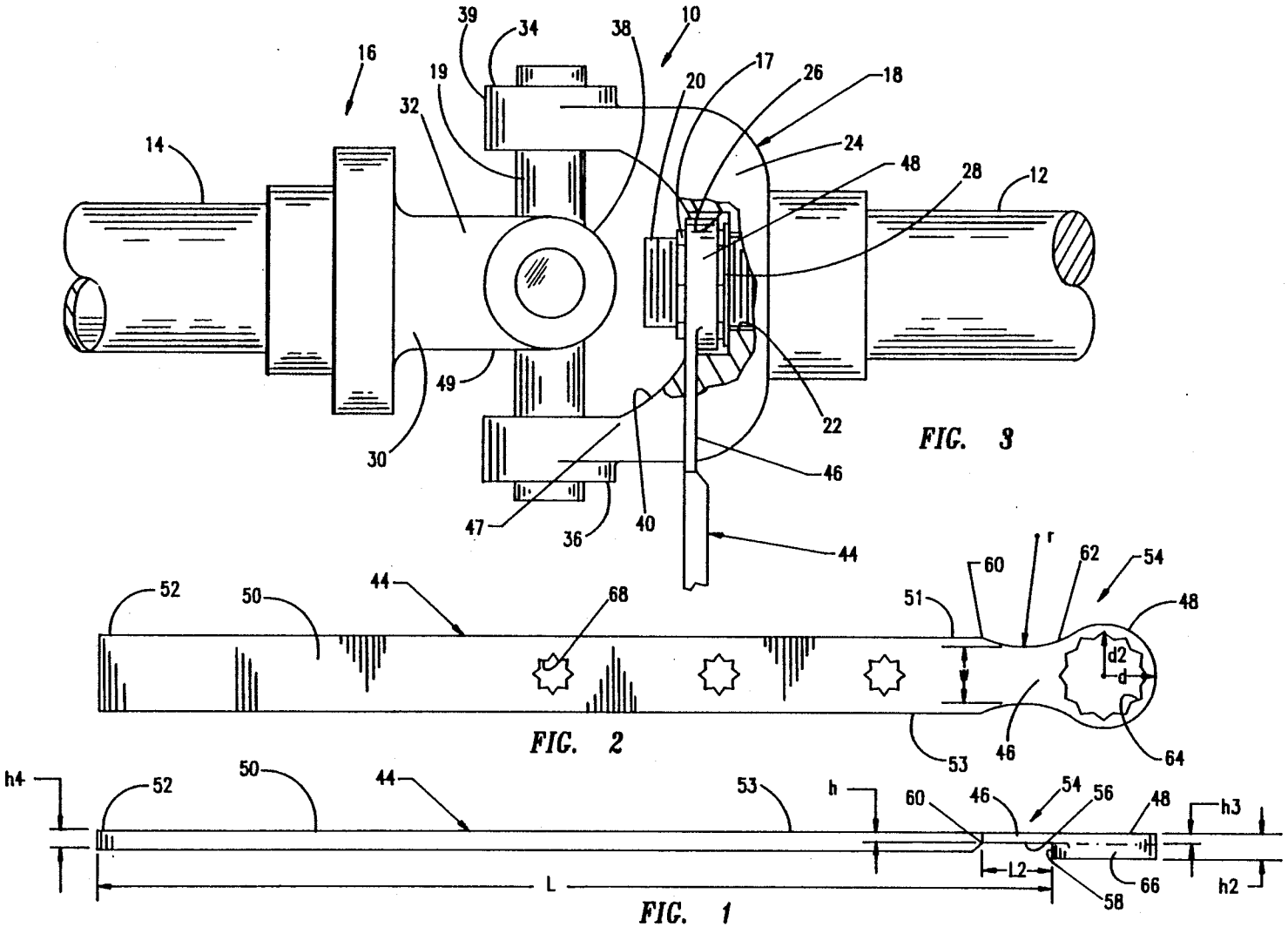
FIG. 1 is an elevation view of the wrench of the present invention.
FIG. 2 is a top view of the wrench of FIG. 1.
FIG. 3 is a side elevational view of a yoke and universal joint in assembled position, with the wrench of the present invention inserted in engaged relation with the yoke retaining nut.

Typically, most vehicles employ a drive shaft having a yoke and universal joint (U-joint) assembly located at each end thereof which transmits rotary motion from the transmission to the rear end (differential) and also allows the drive shaft to move up and down to match the motion of the rear end. The front (transmission) yoke and universal joint assembly connects the drive shaft to the transmission, and the rear (differential) yoke and universal joint assembly connects the differential to the rear end of the drive shaft.

FIG. 3 illustrates a yoke and universal joint assembly 10 which connects a stub shaft 12 (which could be from either the transmission or differential) with the drive shaft 14 of the vehicle. The assembly shown in FIG. 3 is illustrative of both the forward and rear U-joint assemblies.

As shown in FIG. 3, the yoke and universal joint assembly 10 is shown to include a pair of yokes 16 and 18 connected by a cross-type universal joint or spider 20, as is well known in the art. Yoke 16 is connected to shaft 14, and yoke 18 is connected to shaft 12. Yoke 16 is typically connected to the end of drive shaft 14 by welding or by other means known in the art. However, yoke 18 is generally connected to stub shaft 12 by a nut 17 as shown in FIG. 3. Nut 17 is secured to a threaded shaft 20 which extends through an opening 22 in the body 24 of yoke 18. Opening 22 communicates into a recess 26 provided in body 24, and when the yoke and universal joint is in the assembled position, nut 16 and its accompanying washer 28 are seated in recess 26.

As can be further seen in FIG. 3, yoke 16 includes a pair of spaced arms or trunnions 30 and 32, and yoke 18 includes spaced arms or trunnions 34 and 36. Each of the trunnions of one yoke extends into spaces provided between the trunnions of a respective mating yoke. As can be seen from the enlarged assembled view (FIG. 3), there is very little clearance between the outer extending surfaces 38 of each of the trunnions and the inner surfaces 40 of each of the trunnions of the mating yoke.

FIG. 3 illustrates the wrench 44 of the present invention as being inserted between yokes 16 and 18 and positioned on nut 17 for tightening thereof. In order for wrench 44 to be placed in this position, it is necessary that the wrench have a neck portion 46 and head 48 of such shape and size that these portions of wrench 44 can "clear" the edge surfaces 47 and 49 of the respective trunnions and also fit into the combined spaces between the yokes.

FIGS. 1 and 2 illustrate the wrench 44 used in FIG. 3. As seen in FIGS. 1 and 2, wrench 44 includes an elongated handle 50 having substantially parallel sides 51 and 53, a distal end 52, and an end 54 which mates with head 48 of the wrench. Upper surface 53 of the wrench is a substantially flat surface extending from distal end 52 across the entire head 48 of the wrench. Handle 50 is provided with a length, L, and also includes the reduced neck portion 46 which is provided with height, h, and a radius of curvature, r, which results in a width, w, at the narrowest point of the neck portion. Neck portion 46 further includes a cut-away bottom surface 56 which extends a length, $L_2$, from the innermost outer surface 58 of head 48 to a point 60 of surface 56 which connects the arc 62 provided by radius R with the sides 51 and 53 of the handle. The shape and size provided by these dimensions must permit the head and neck of the wrench to slide past the extending surfaces 49 and inner surfaces 47 of the trunnions of the two yokes. The head portion 48 is provided with an outside diameter, d, which permits the head of the wrench to fit into recess 26 of the yoke body and over the nuts 17. The head portion 48 further includes an inner surface 64 having a diameter, $d_2$, which is the inner diameter of the nut engaging portion of the wrench. Diameter $d_2$ is provided in varying sizes to match the diameter of the head of the nut. Head portion 48 is also provided with a height, $h_2$, which permits the insertion of the head of the wrench past the extending surfaces 38 of the trunnions and the inner surfaces 47 of the trunnions of the mating yoke. Head 48 further includes an extending lower portion 66 (FIG. 1) having a height $h_3$ which permits the head of the wrench to project into recess 26 of the body 24 of yoke 18 for engaging the nut 17.

Some representative values of the handle, neck, and head of the wrenches are as follows: length of handle, L=17"; width of neck, W=1½"; thickness of neck, h=¼"; height of head, h=11/16"; length of neck, $L_2$=1¼"; external diameter of head, $d_1$=variable smaller than recess 26; and $d_2$=variable. The diameter, $d_2$, of the nut engaging head portion is sized to fit any size of yoke nuts (1¾"-2"-2½"-2¾", etc.), and $d_2$ is sized to permit the lower portion 66 to be inserted into recess 26.

If desired, the handle may have a plurality of eight-point holes 68 for receiving a pull handle therein to torque the nuts to the specified tightness. While three holes are shown, it is to be understood that as many holes as desired may be resorted to. Also, it should be noted that, if desired, the thickness of the handle and neck portions may be equal.

The method of using the wrench of the present invention is relatively very simple. One merely inserts the head of the wrench into the opening of the yoke with the bottom cut-away surface 56 adjacent to edge surface 47 of a trunnion of one of the yokes. The cut-away portion permits the wrench to be inserted past the extending trunnion surfaces so that the nut engaging surface 64 of the head may be positioned on the nut. Typically, the nut engaging surface 64 would be provided with many engaging points (18 points+) so that the wrench may be swung in a wide arc. Also, the cut-away side surfaces 62 permit the wrench to be swung in a wider arc than would be possible with a wrench not provided with sides of this configuration.

Having described preferred embodiments of the present invention with reference to the accompanying drawings, it is to be understood that the invention is not limited to those precise embodiments and that various modifications can be made to the invention by one of ordinary skill in the art without departing from the scope and spirit of the invention as defined by the appended claims.

We claim:

1. A wrench disposed for insertion into a yoke/U-joint assembly of a vehicle, said yoke provided with extending spaced trunnions and having a body provided with a recess for receiving a yoke securing nut therein, said recess disposed on said body between said trunnions, said nut disposed for threaded engagement with a threaded portion of a shaft to which said yoke is to be secured, said threaded portion of said shaft extending through an opening in said body of said yoke for secured relation thereto responsive to said threaded engagement with said nut, said wrench comprising:

a handle having first and second ends and first and second sides and a neck portion at said first end, said neck portion having a dimensionally reduced cross section relative to said sides of said handle, to form a neck portion of predetermined thickness a predetermined width; and a nut engaging head secured to said neck portion, said head including an extending portion of predetermined diameter for insertion into said recess of said body of said yoke, said head including said extending portion provided with an inner nut engaging surface for engaged relation of said nut in said recess;

said handle and said head are provided with mating planar upper surfaces;

said predetermined with of said neck portion is provided by providing each said side, at said neck portion, with a cut-away portion, said cut-away portions providing said neck portion with a smaller width than the remainder of said handle, said cut-away portions permitting said handle to be swung in a wider arc than would be otherwise possible without said cut-away portions; and said neck portion includes upper and lower surfaces, and said predetermined thickness of said neck portion is provided by providing said lower surface of said neck portion with a recessed surface, to reduce the thickness of said neck portion relative to the thickness of said head and said handle, said recessed surface permitting insertion and rotational movement of said neck portion and head between adjacent spaced surfaces of said yokes.

2. A wrench as set forth in claim 1 wherein said predetermined width of said neck portion is smaller than the width of said handle.

3. A wrench as set forth in claim 1 wherein said extending head portion extends beyond said lower surface of said neck portion a distance substantially equal to the depth of said recess in said body of said yoke.

4. A wrench as set forth in claim 3 wherein said trunnions of said yokes include external surfaces, said neck portion being provided with a length, $L_2$, said length being sufficient to permit insertion of said head and neck portions of said wrench into said yokes without engaging the external surfaces of said yokes.

5. A wrench as set forth in claim 4 wherein said cut-away portions of said neck portion extend a distance $L_2$ from said external surface of said head portion, said distance $L_2$ being sufficient to permit said handle to be rotated in an arc limited only by engagement of said arcuate surfaces of said neck portion of said handle with said edge surfaces of said yoke.

6. A wrench as set forth in claim 1 wherein said handle includes at least one opening between said first and second ends to receive a pull member for torqueing said nut to the desired tightness.

7. A wrench as set forth in claim 6 wherein said cut-away portion of said sides of said neck portion is provided with an arcuate configuration.

* * * * *